US007228659B2

(12) United States Patent
Romero et al.

(10) Patent No.: US 7,228,659 B2
(45) Date of Patent: Jun. 12, 2007

(54) SLIDING DOOR REINFORCED FRAME HEADER WITH MOVABLE COVER

(75) Inventors: Federico Romero, Corpus Christi, TX (US); William S. Liles, Jr., Corpus Christi, TX (US)

(73) Assignee: Overhead Door Corporation, Lewisville, TX (US)

( * ) Notice: Subject to any disclaimer, the term of this patent is extended or adjusted under 35 U.S.C. 154(b) by 306 days.

(21) Appl. No.: 10/754,988

(22) Filed: Jan. 9, 2004

(65) Prior Publication Data

US 2005/0150168 A1 Jul. 14, 2005

(51) Int. Cl.
*E05D 15/06* (2006.01)

(52) U.S. Cl. ..... 49/409; 49/324; 49/125; 52/207; 16/96 R; 16/94 R; 16/268

(58) Field of Classification Search ..... 49/404, 49/324, 360, 409, 396, 141, 176, 177, 125, 49/127, 128, 129, 130; 52/207, 204.51; 16/96 R, 16/94 R, 268
See application file for complete search history.

(56) References Cited

U.S. PATENT DOCUMENTS 3,464,159 A 9/1969 Hewitt et al.
3,466,805 A * 9/1969 Muessel ..... 49/141
3,473,266 A 10/1969 Miller
3,491,483 A * 1/1970 Miller ..... 49/141
3,925,933 A * 12/1975 Reuter ..... 49/409
3,981,203 A 9/1976 Williams
4,237,655 A * 12/1980 Yamao ..... 49/252
4,404,770 A 9/1983 Markus
4,438,594 A * 3/1984 Bunzl ..... 49/177
6,098,342 A 8/2000 Bischof et al.
6,253,492 B1 7/2001 Finke
6,446,394 B1 9/2002 Finke et al.
6,516,566 B2 2/2003 Finke
6,526,695 B1 3/2003 Nguyen
2002/0069588 A1 6/2002 Finke et al.

* cited by examiner

*Primary Examiner*—Gregory J. Strimbu
(74) *Attorney, Agent, or Firm*—Gardere Wynne Sewell, LLP

(57) ABSTRACT

A sliding door includes a frame comprising an elongated header member having a topwall, a backwall, an intermediate wall and a bottom wall. The bottom wall and intermediate wall are engageable with sliding door panel support rollers and the bottom wall and intermediate wall are interconnected by a separate support member to distribute door panel loads between such walls. A movable cover is attached to the header member by a hinge part including spaced apart flanges and projections co-operable with projections on the header member to support the cover in open and closed positions. The door operator is supported in the header member by a single angle-shaped frame member supporting a power supply, a controller and a door operator motor. An adjustable torsion bar assembly supports the door panel against sagging.

13 Claims, 6 Drawing Sheets

SLIDING DOOR REINFORCED FRAME HEADER WITH MOVABLE COVER

BACKGROUND OF THE INVENTION

In the art of motorized sliding doors, there is a continuing need for improvements in the door support structure, including the so-called the header rail structure which is adapted to support one or more sliding door panels, motor controls and the door operator and motor. Improvements in access to this support structure for adjusting and servicing the controls and the operator mechanism have also been sought. In this regard the lack of ease with which the controls and the motor operator may be installed in and removed from the header has also been a somewhat nettlesome problem.

Still further improvements which have been sought in the art of sliding doors include improvements in a so-called torsion bar assembly which supports the sliding door panel or panels in the situation wherein a panel is of the breakaway type which may be swung open in an emergency.

The desire and need for improvements in sliding doors with regard to the above-noted features, as well as certain other improvements which have been sought, has resulted in the present invention.

SUMMARY OF THE INVENTION

The present invention provides an improved motorized sliding door including, in particular, an improved header or overhead support structure for such doors wherein such support structure is strengthened to support one or more sliding door panels. The header is also adapted to support a removable frame which supports a door drive motor and door controls. The invention also contemplates an improved access door or cover which provides ease of access to the operator motor and the controls.

In accordance with another aspect of the invention the door header comprises an extruded beam with spaced apart door panel support rail parts and a separate reinforcing member interconnecting the rail parts. The improved access door or cover and the header are configured to be connected in such a way that the cover is supported in both an open position and a closed position by uncomplicated but unique structure.

Still further, the present invention provides an improved arrangement of a so-called torsion bar assembly for supporting a door panel to breakaway from its normal working position in an emergency and whereby the door panel may be restored to its original working position without requiring refitting the door. In this regard the door is at least partially supported by the torsion bar assembly which includes an improved adjustment feature which provides for ease of adjustment to minimize or eliminate any sag in the door panel when it moves from its normal working position to a swung open position.

The above-noted features and advantages of the present invention together with other important aspects thereof will be further appreciated by those skilled in the art upon reading the detailed description which follows in conjunction with the drawings.

DETAILED DESCRIPTION OF PREFERRED EMBODIMENTS

Figure 1:
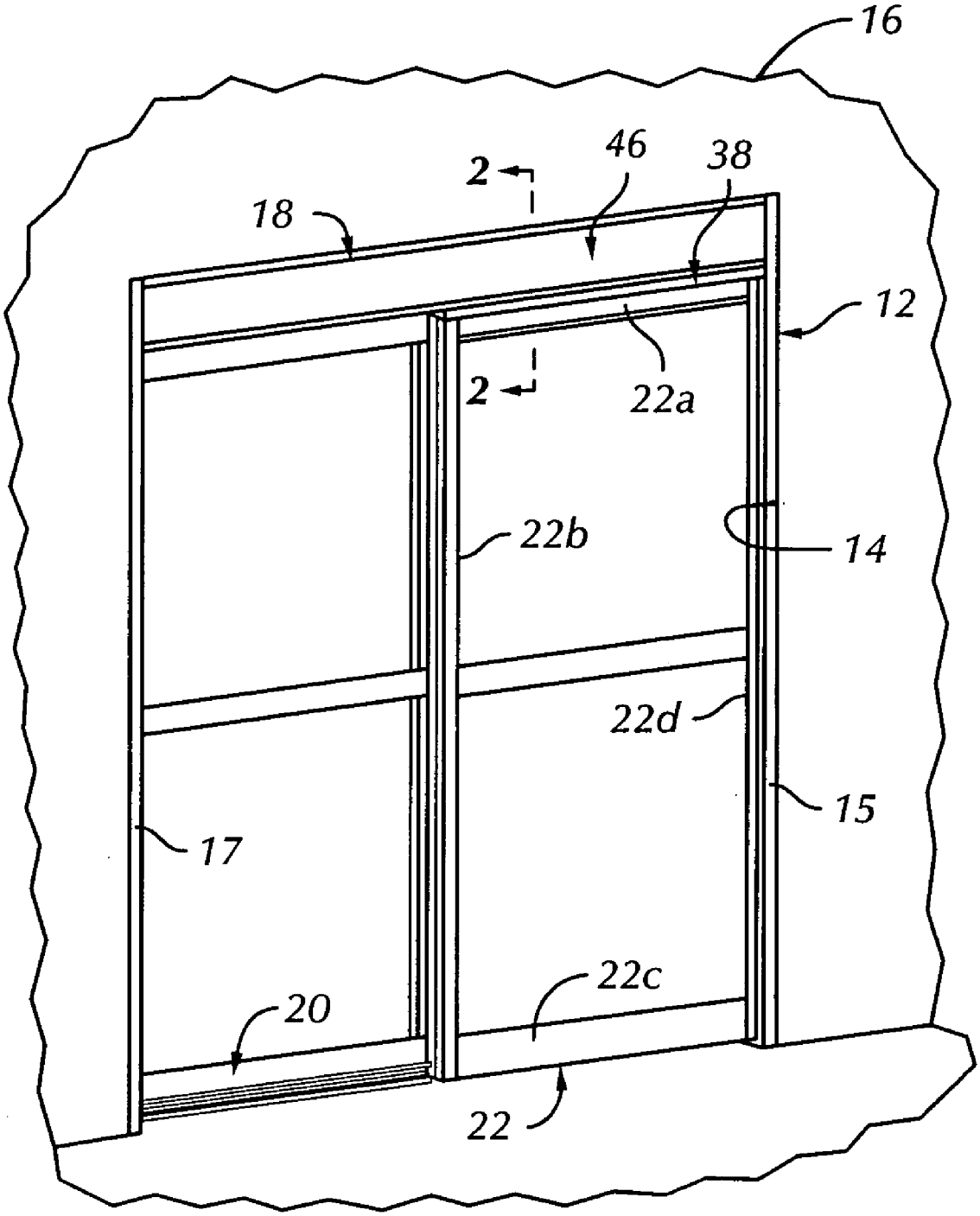
FIG. 1 is a perspective view of a sliding door including the improvements of the present invention.

In the description which follows like parts are marked throughout the specification and drawings with the same reference numerals, respectively. The drawings are not necessarily to scale and certain features may be shown in somewhat schematic or generalized form in the interest of clarity and conciseness.

Referring to FIG. 1, there is illustrated an exemplary embodiment of a sliding door, including improvements in accordance with the present invention, which door is generally designated by the numeral 12. The door 12 is disposed in an opening 14 in a wall 16 and is supported by a frame including spaced apart, vertically extending frame members 15 and 17 and a transverse horizontal frame member or header 18. The aforementioned frame, including the header 18, supports a stationary panel 20 and a moveable, sliding door panel 22. Panel 22 is supported substantially by the header 18 and is moveable between the closed position shown and an open position overlying the panel 20 in a conventional manner.

Figure 2:
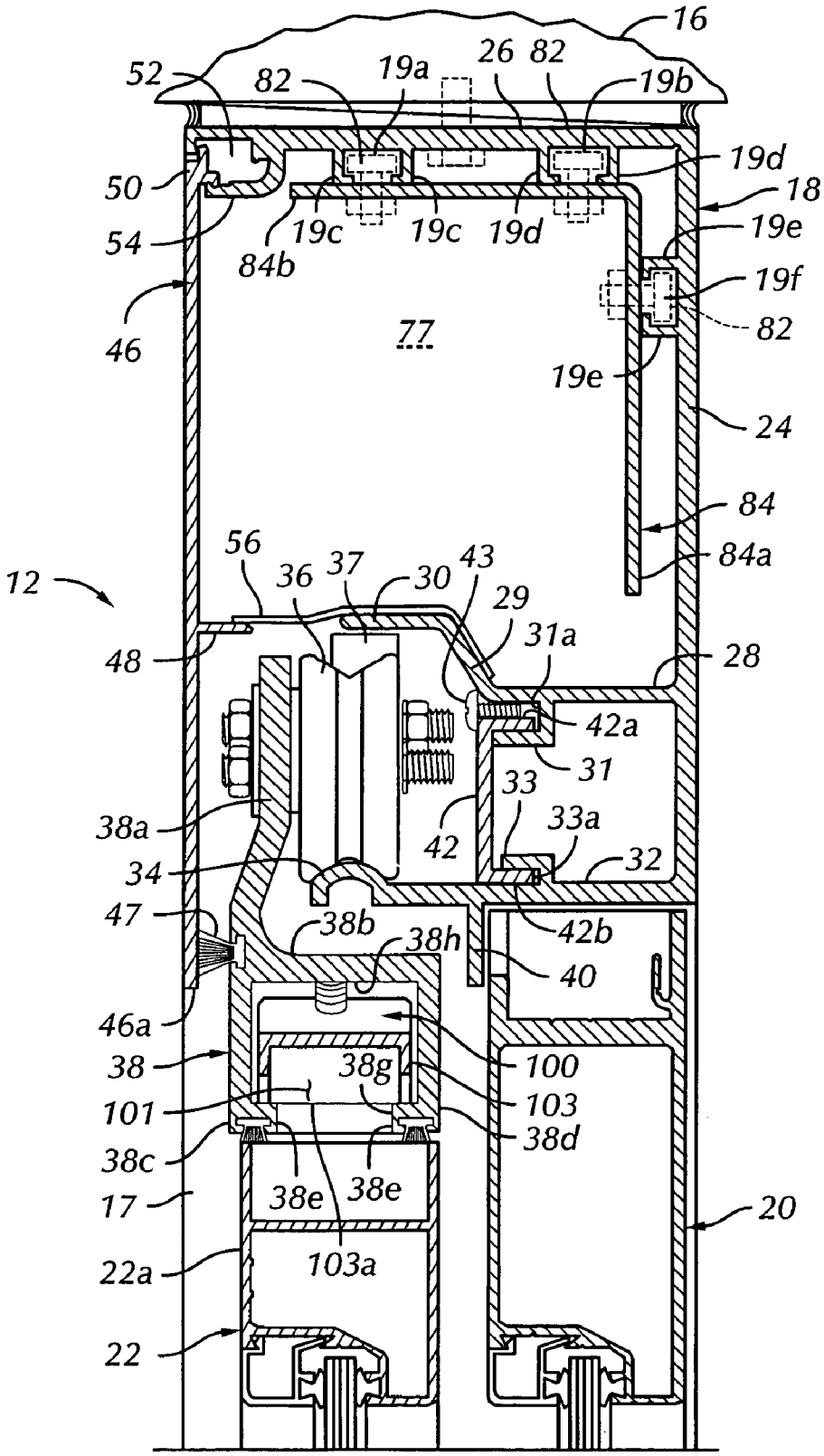
FIG. 2 is a detail section view taken generally along the line 2—2 of FIG. 1.

Referring now to FIG. 2, there are shown additional details of the header 18 as well as the panels 20 and 22. The header 18 is preferably formed as an elongated beam of extruded metal and includes an elongated, planar backwall 24 which is formed integral with a generally horizontally extending top wall 26. A transverse, elongated intermediate wall member 28 is formed integral with and extends generally normal to the backwall 24 and includes an offset elongated distal end rail part 30 supported by a transition part 29. The header 18 also includes a transverse bottom wall 32 formed integral with the backwall 24 extending normal thereto and spaced from the intermediate wall 28. The bottom wall 32 includes an elongated cantilever, distal end rail part 34 which is crowned to form a support rail for spaced apart door panel support rollers 36, as shown, see FIG. 6 also. Rollers 36 and spaced apart anti-rise rollers 37 are suitably mounted on an elongated sliding door panel support bracket 38 which will be described in further detail herein. A depending flange 40, FIG. 2, extends downward from bottom wall 32. Bottom wall 32, and intermediate wall member 28, include elongated generally parallel flanges 33 and 31, as shown, which are generally parallel to the walls 28 and 32 and thus to each other. Flanges 31 and 33 are formed integral with walls 28 and 32 and are offset therefrom to provide respective slots 31*a* and 33*a*.

As further shown in FIG. 2, an elongated channel shaped support member 42 fits snugly against the flanges 31 and 33, thanks to its own opposed flanges 42*a* and 42*b* which are disposed in the slots 31*a* and 33*a*. Support member 42 is held firmly in place by spaced apart screw fasteners 43, one shown in FIG. 2, which essentially wedge between the intermediate wall 28 and the flange 42*a* of the support channel member 42. Provision of the separate member 42 simplifies the extrusion process and equipment required for extruding the header 18. However, the bottom wall 32 and intermediate wall 28 are also both strengthened and deflection of same is minimized by connecting these walls together with the support member 42. In this way the downward directed bending loads on the wall 32 and distal rail part 34 are transferred at least partially to the wall 28 and, should the door panel 22 undergo a rising motion, the anti-rise flange or rail part 30 engages at least one or more of the rollers 37 to minimize upward motion of the panel 22. In such an occurrence, any loads imposed on the cantilever, anti-rise rail part 30 of intermediate wall 28 are partially transferred to the bottom wall 32. In this way a stiffer and more properly stressed header 18 is provided in accordance with the invention.

Figure 3:
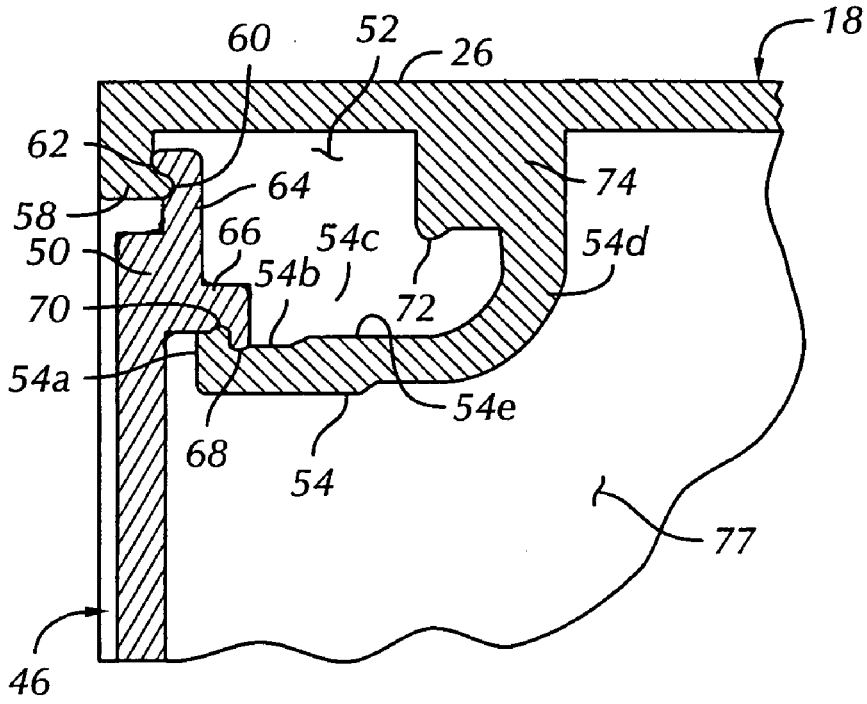
FIG. 3 is detail section view of an access door or cover on a larger scale and taken generally from the same line as the view of FIG. 2.
Figure 4:
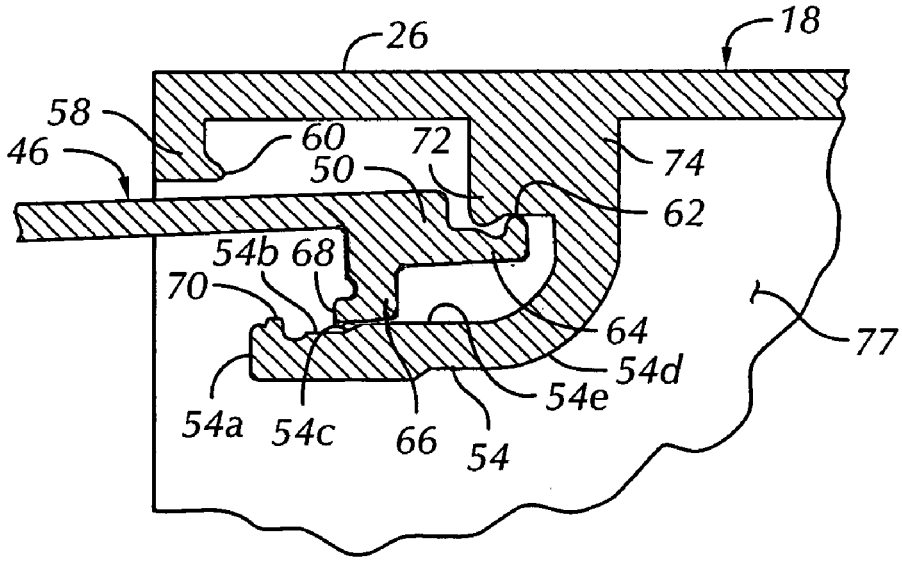
FIG. 4 is a detail section view similar to FIG. 3 but showing the access door in its open position.

Referring further to FIGS. 2, 3 and 4, the header member 18 is provided with improved support for an access cover or closure member 46 which comprises an elongated generally flat plate member having one or more transverse latching tabs 48 formed thereon. The cover member 46 also includes an integral hinge part 50 which fits within a hinge recess 52 formed on the header member 18 and defined in part by a depending and generally horizontally extending leg 54 which is generally co-extensive and integral with the header top wall 26. One or more spaced apart latch members 56, FIG. 2, are suitably secured to intermediate wall 28, particularly at portions 29 and 30, and extend into engagement with the transverse latch members 48. The member or members 56 may comprise elastically deflectable metal strips which are suitably secured to the distal portions 29, 30 of intermediate wall 28 and forcibly engage the latch members 48. Latch strips 56 may be secured spaced apart along the length of intermediate wall 28 which is preferably co-extensive with backwall 24, bottom wall 32 and top wall 26.

Referring now to FIGS. 3 and 4, distal end 54*a* of wall or leg member 54 is spaced from a depending flange 58 which is formed integral with top wall 26. Flange 58 includes a generally horizontally extending, elongated, arcuate projection 60 which is co-operable with an arcuate projection 62 formed on an upstanding flange part 64 of hinge part 50. Hinge part 50 also includes a transverse flange 66 extending normal to the flange 64 and provided with a downwardly facing arcuate projection 68 co-operable with an upward facing arcuate projection 70 formed on the distal end 54*a* of the depending leg member 54.

Accordingly, in the position shown in FIG. 3, the door or cover 46 is closed and the opposing projections 62 and 68 engage and cooperate with the projections 60 and 70 on the header 18 to support the cover 46 in a closed and secured position, together with the latching feature 48, 56. As shown in FIG. 2, the lower end 46*a* of the cover 46 is engageable with a resilient seal member 47 supported on bracket 38. However, referring to FIG. 4, the cover 46 may be moved to an open and secured position, generally as shown. When the cover 46 is in the position shown in FIGS. 2 and 3, it may be rotated by grasping the lower end 46*a* and pulling away from the header 18 in a somewhat clockwise direction, viewing FIGS. 2, 3 and 4. When the door or cover 46 is rotated, it tends to pivot about the center of the hinge part 50 whereby the projection 62 moves away from the projection 60 and the projection 68 may be slid along a shelf-like surface 54*b*, 54*c* and 54*e* toward a depending projection 72. Projection 72 is formed on a boss 74 formed integral with wall 26 and leg 54.

However, once the flange 66 encounters sloping surface portion 54*c*, FIGS. 3 and 4, the cover 46 may be rotated further clockwise until the flange 64 projects substantially horizontally whereupon the cover 46 may also be moved toward the arcuate portion 54*d* of depending leg member 54 until the distal end of the flange 64 engages the leg portion 54*d*. In this condition, the flange 66 is resting on the inner surface 54*e* of leg member 54, as shown in FIG. 4, and when the cover 46 is released it will tend to rotate in a counter-clockwise direction, viewing FIG. 4, whereby the projection 62 will engage the projection 72 and the door or cover 46 will be secured in the open position shown. The hinge part 50, leg member 54 and boss 74 are also proportioned such that, in the open position of cover 46, the cover extends at a slight downward inclination, as shown, to facilitate grasping and moving the cover in applications of the operator where a low ceiling may be directly adjacent the top wall 26 of the header 18.

When it is desired to move the cover 46 to the closed position shown in FIGS. 2 and 3, the cover is again grasped and moved slightly in a clockwise direction until the cover engages the lower end of the flange 58 at which time it may be pulled to the left, viewing FIG. 4, so that the projection 62 clears the projection 72 whereupon the cover may be released or lowered to the position shown in FIGS. 2 and 3. Accordingly, the configuration of the hinge part 50 of cover 46, in cooperation with the configuration of the structure defining the recess 52 provides an uncomplicated hinge connection between the header 18 and the cover 46 which allows the cover to be easily secured in a closed position and also an open position while service personnel gain access to an interior space 77, FIG. 2, of the header 18.

Referring again to FIG. 2, an important aspect of the header 18 is the provision of spaced apart elongated slots 19*a* and 19*b* which are formed by elongated depending and spaced apart wall parts 19*c* and 19*d*, respectively. The wall parts 19*c* and 19*d* have re-entrant edges delimiting the widths of the slots 19*a* and 19*b*. Spaced apart laterally projecting elongated wall parts 19*e* are formed integral with backwall 24 and also are provided with re-entrant edges to delimit the width of a slot 19*f*. The slots 19*a*, 19*b* and 19*f* are adapted to receive heads of square-head machine screws or bolts 82, as shown in FIG. 2, and also FIG. 5. The widths of the slots 19*a*, 19*b* and 19*f* are only slightly greater than the widths across the flats of the heads of screws 82 so that the screws do not rotate once their heads are placed within the slots, as shown in FIG. 2. Screws 82 are adapted to support an elongated angle-shaped frame 84 having a depending wall or flange 84*a* and a generally horizontally extending flange or wall 84*b*. Accordingly, an elongated angle-shaped member defines frame 84, FIG. 5, and which is adapted to support several components making up an operator for motorized operation of the door panel 22.

Figure 5:
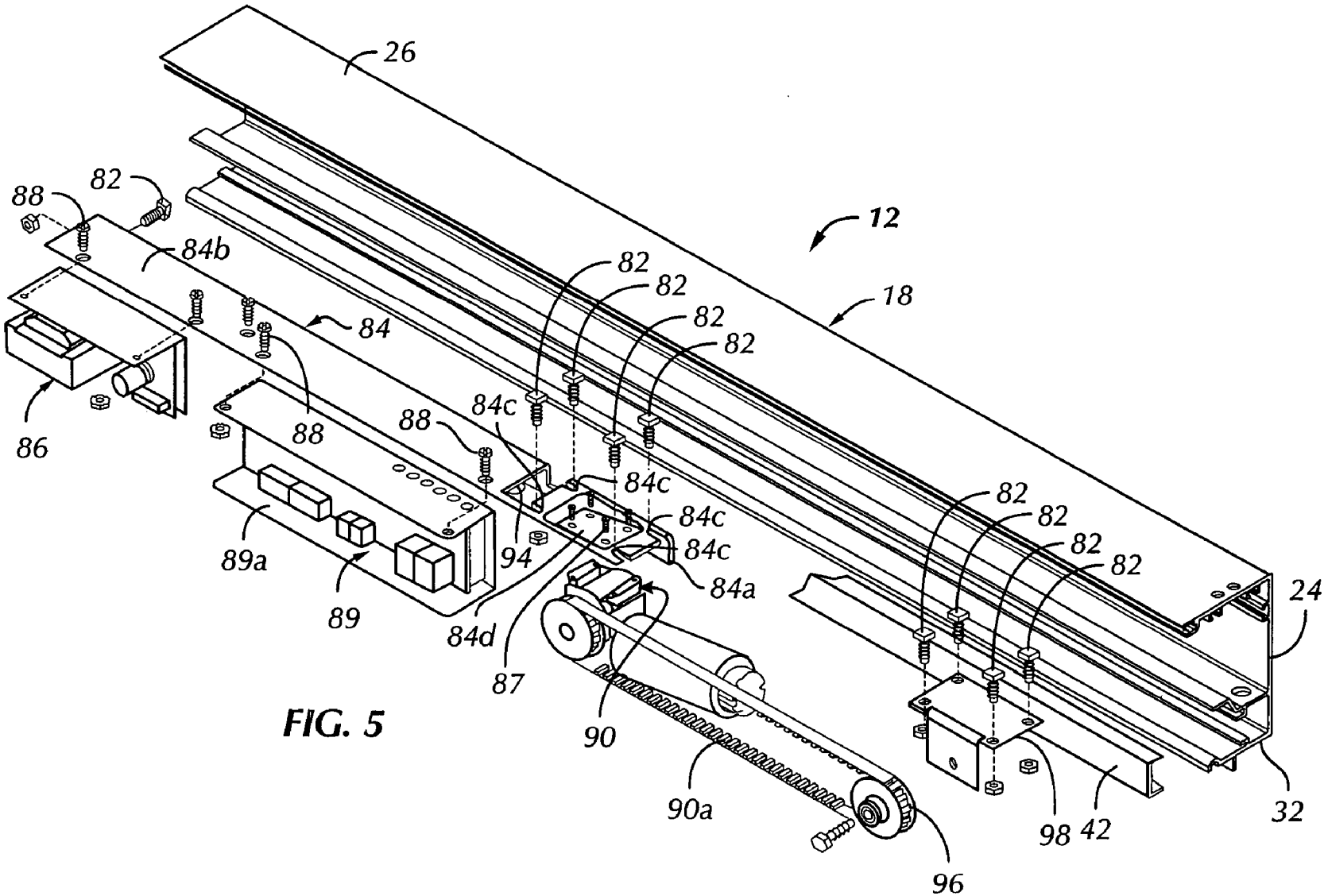
FIG. 5 is an exploded perspective view of the door header, an operator support frame and certain operator components.

For example, as shown in FIG. 5, an electrical power supply unit 86 may be removably secured to the flange 84*b* by suitable mechanical fasteners 88. In like manner a control unit 89 having a suitable chassis 89*a* therefor may also be secured to the flange 84*b* by fasteners 88, as shown in FIG. 5. Still further, a drive motor and speed-reducing drive unit 90 may also be secured to the elongated frame 84 at an offset mounting plate portion 84*d* by suitable fasteners 87, FIG. 5. As further shown in FIG. 5, the flange 84*b* is provided with opposed slots 84*c* which open to one end of the frame 84 and to a recess 94, respectively. In this way the frame 84 may be secured to the header 18, as shown, and may be adjusted longitudinally along the header as required while essentially all of the components of the door operator comprising the power supply 86, the control unit 89 and the operator motor and drive unit 90 are supported by a single-frame member 84. As further shown in FIG. 5, a cog-belt 90*a* comprising part of the operator for the door 12 is trained over a drive sprocket 96 mounted on a suitable support plate 98 which is also supported within the space 77 by connection of same to further sets of screws 82 disposed in the header slots 19*a* and 19*b*. In this way the entire operator assembly for door 12 may be easily mounted on, removed from and adjusted as to its position with respect to the header 18.

Figure 6:
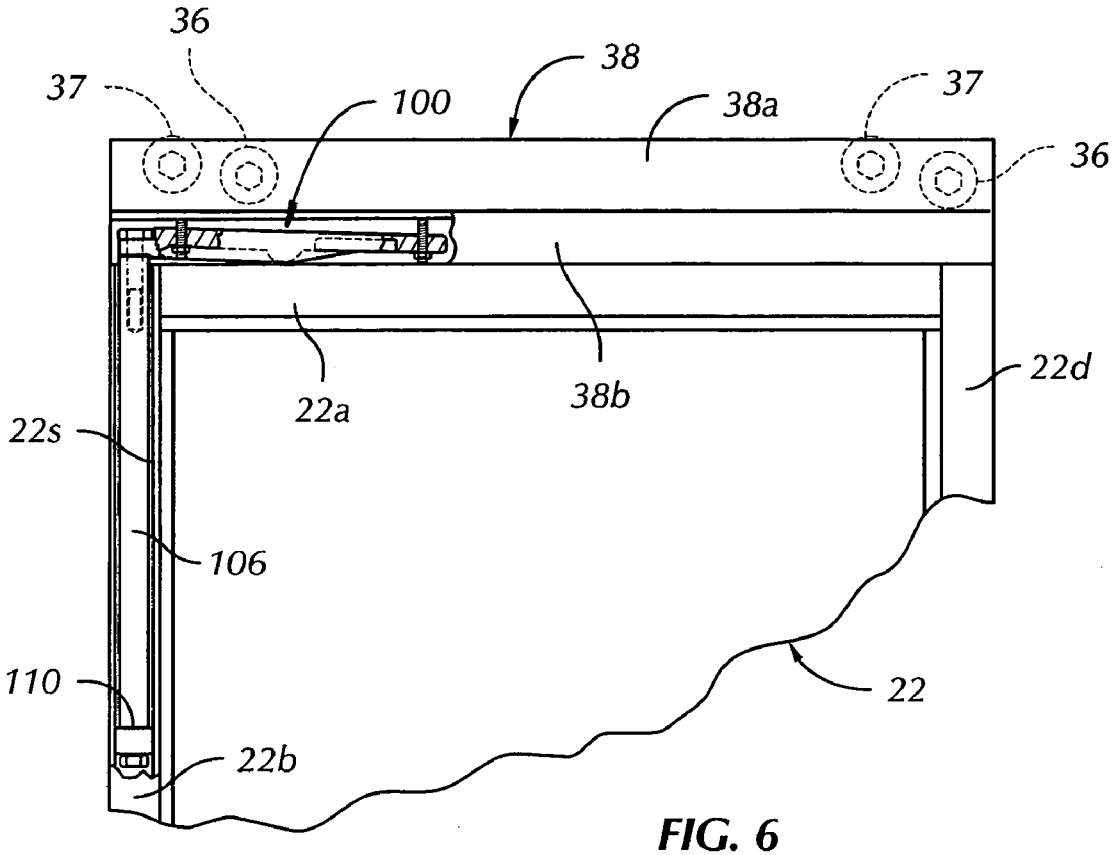
FIG. 6 is a detail view of a portion of the sliding door panel and a support bracket therefor and showing the location of an improved torsion bar and hinge assembly.
Figure 7:
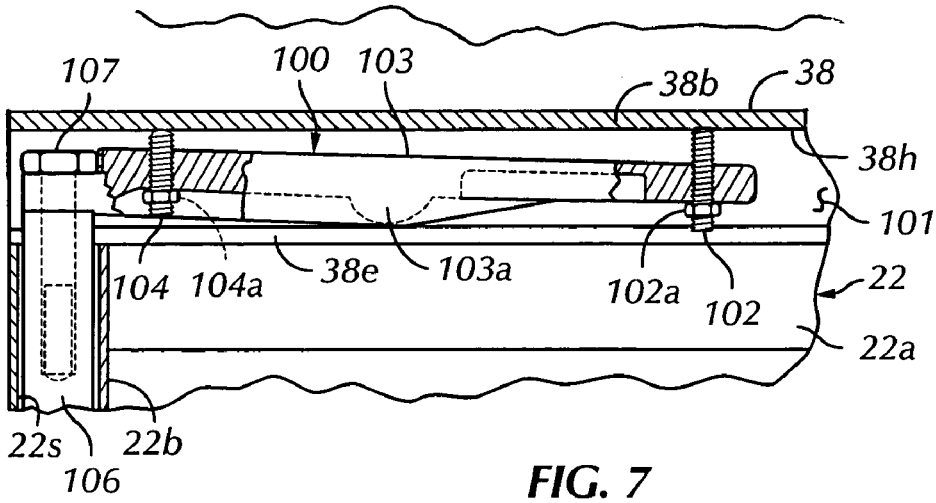
FIG. 7 is a detail section view similar to FIG. 6 but on a larger scale.

Referring further to FIGS. 2, 6 and 7, the door 12 includes an improved so-called torsion bar and pivot support assembly in accordance with the invention and generally designated by the numeral 100. As previously discussed, the door panel 22 is preferably characterized by a perimeter frame made up of members 22*a*, 22*b*, 22*c* and 22*d*, see FIG. 1 also, supported for sliding movement along the header 18 by the bracket 38. The bracket 38, viewing FIG. 2, includes an upstanding elongated flange 38*a* to which spaced apart support rollers 36 and 37 are suitably secured. Bracket 38 includes a depending inverted channel-shaped part 38*b* including depending sidewalls or flanges 38*c* and 38*d*, both provided with respective re-entrant distal edges facing each other and designated by the numerals 38*e*, respectively. Bracket 38 supports an elongated rectangular cross section member 103 of the torsion bar assembly 100 within space 101, FIG. 2, defined by the channel-shaped part 38*b* of the bracket 38 previously described. The space 101 opens to opposite ends of the bracket 38, as shown by way of example in FIG. 7. A slot 38*g*, FIG. 2, is formed between flange distal ends 38*e* to provide access to adjusting screws 102 and 104 which are threadedly engaged with and extend through the torsion bar member 103. The overall width of the torsion bar member 103 is slightly less than the width of the space 101 between the bracket flanges or sidewalls 38*c* and 38*d* and the torsion bar member 103 also includes a fulcrum point 103*a* which rests on the flange re-entrant edges 38*e*. Screws 102 and 104 are forcibly engageable with bracket web part 38*h* and may be separately adjusted to minimize sag of panel 22 with respect to hanger bracket 38.

Figure 8:
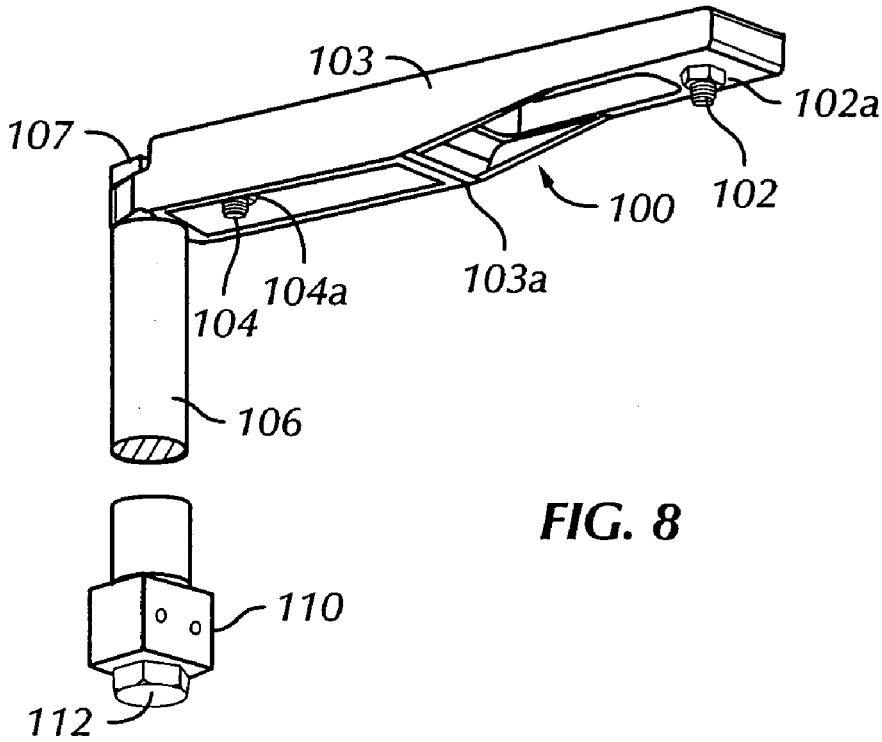
FIG. 8 is a perspective view of the torsion bar assembly shown in FIGS. 6 and 7.
Figure 9:
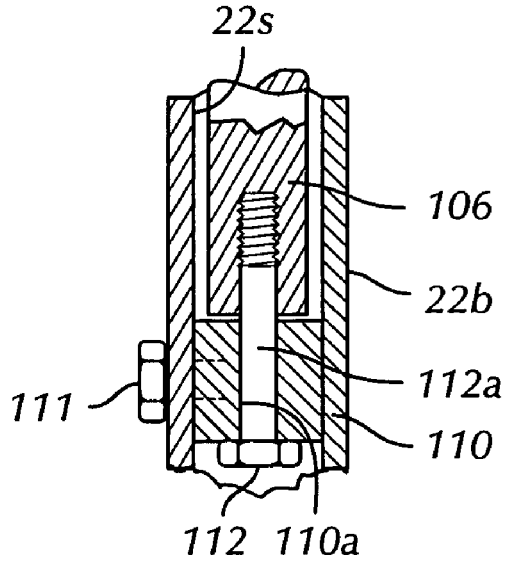
FIG. 9 is a detail view of a part of the torsion bar assembly showing a connection to a door panel.

Referring again primarily to FIGS. 6 and 7, torsion bar member 103 is connected at one end to a pivot pin 106 by hex-head machine screw 107, FIG. 7. Pivot pin 106 depends within a space 22*s* formed within the square-tube cross section of frame member 22*b* and terminates at a stationary support block 110, FIGS. 6, 8 and 9. Support block 110 fits within the space 22*s* defined by the square cross section tubular frame member 22*b* and is suitably secured thereto non-rotatably with respect to the frame member by fasteners 111, one shown in FIG. 9. Support block 110 is secured to pin 106 by a suitable mechanical fastener 112 having a cylindrical bearing pin portion 112*a* disposed in a bore 110*a* of block 110, FIGS. 8 and 9. Thus pin 106 is rotatable relative to block 110. Accordingly, torsion bar pin 106 forms a hinge connection between the bracket 38 and the door panel 22 so that, during an emergency, the door panel 22 may be swung with respect to the frame defined by members 15, 17 and 18. However, since the torsion bar member 103 and hinge pin 106 support a significant part of the weight of the door panel 22, the panel would tend to sag except for the torsion bar assembly 100 which resists deflection and may be adjusted to minimize any deflection or sag of the door panel 22 when it is not in its normal working position. Door panel 22 may be supported at its bottom edge by a hinge pin, not shown, in a conventional manner. Door panel 22 may also be latched in its normal working position by a yieldable latch, also not shown.

Thanks to the spaced apart adjusting screws 102 and 104 which are disposed on opposite sides of the fulcrum 103*a* the torsion bar member 103 may be adjusted to minimize any sag of the panel 22 door when it is pivoted about the central longitudinal axis of pin 106 and out of its normal working position, such as during an emergency situation wherein the door panel 22 is required to breakaway from the bracket 38 in the sense that it is required to rotate with respect to the bracket 38. The screws 102 and 104 are preferably provided with socket-head end portions and facing downward so that the screws may be accessed by a suitable wrench projecting through the slot 38*g*. The screws 102 and 104 may be locked in their adjusted positions by suitable locknuts 102*a* and 104*a*, FIG. 7.

The construction and operation of the sliding door 12, including the improvements described herein, is believed to be readily understandable to those of ordinary skill in the art. Conventional engineering materials and fabrication processes may be used to fabricate the components described herein and substantially conventional assembly procedures may be used to assemble the door 12 and the components described. Although a preferred embodiment of the invention has been described in detail, those skilled in the art will also recognize that various substitutions and modifications may be made without departing from the scope and spirit of the appended claims.

What is claimed is:

1. In a sliding door system including at least one slidable door panel, a frame including an elongated header part, said header part including a generally vertical backwall, a topwall, a bottom wall including a distal end part thereof forming a rail for supporting door panel support rollers, an intermediate wall connected to said backwall and spaced from said bottom wall and including an anti rise distal rail end part engageable with at least one anti rise roller operably connected to said door panel, and an elongated support part engaged with said intermediate wall and said bottom wall to transfer forces acting on said bottom wall and said intermediate wall therebetween, and said intermediate wall and said bottom wall each include a flange, said flanges being spaced apart from one another and engageable with spaced apart portions of said support part for transferring said forces between said intermediate wall and said bottom wall through said support part.

2. The invention set forth in claim 1 wherein:

said support part comprises a channel member and said portions of said support part comprise opposed flanges engageable with said flanges on said intermediate wall and said bottom wall, respectively.

3. The invention set forth in claim 2 wherein:

said support part is releasably secured in engagement with said intermediate wall and said bottom wall by at least one screw fastener secured to one of said flanges of said support part and a portion of said intermediate wall.

4. The invention set forth in claim 1 wherein:

said header part includes a movable cover for covering a working space in said header part said working space for housing a door operator, said cover includes a hinge part co-operable with a projection supported by said top wall and with a depending leg part connected to said top wall and operable to support said cover on said header part in a closed position and in an open position to provide access to said space.

5. The invention set forth in claim 4 wherein:

said hinge part cooperates with said header part to be held in said open position inclined downwardly away from said top wall.

6. The invention set forth in claim 4 wherein:

said hinge part of said cover includes a first flange projecting generally parallel to a major part of said cover and a second flange projecting generally normal to said first flange, said first and second flanges of said cover including projections formed thereon co-operable with said projection supported by said top wall and a projection on said depending leg part, respectively, for supporting said cover in said closed position.

7. The invention set forth in claim 6 including:

a further projection formed on a boss depending from said top wall and co-operable with said projection of said first flange of said cover for supporting said cover in said open position.

8. The invention set forth in claim 1 wherein:

said header part includes spaced part elongated channel portions formed on said top wall and operable to receive fasteners for releasably supporting an elongated frame of a door operator in a space defined by said header part.

9. The invention set forth in claim 8 wherein:

said door operator frame comprises an elongated angle shaped member adapted to support a power supply, a control unit and an operator motor for.

10. The invention set forth in claim 1 wherein:

said door panel includes a door hanger bracket adapted to be supported by said header part for linear traversal therealong and includes a door panel frame including an elongated, generally vertically extending longitudinal panel frame member, and includes an adjustable torsion bar assembly operable to interconnect said hanger bracket with said frame member of said door panel and adjustable to minimize sagging of said door panel when said door panel is moved from a working position to a pivoted breakaway position with respect to said hanger bracket.

11. The invention set forth in claim 10 wherein:

said torsion bar assembly includes an elongated torsion bar member supported in a channel formed in said hanger bracket and connected to a pivot pin disposed in said frame member of said door panel, said torsion bar member including at least one support point and spaced apart adjustable screw members for adjusting a position of said torsion bar member with respect to said hanger bracket to minimize the sagging of said door panel when swung from said working position to said breakaway position.

12. In a sliding door system including at least one slidable door panel, a frame including an elongated header part, said header part including a generally vertical backwall, a topwall, a bottom wall including a distal end part thereof forming a rail for supporting door panel support rollers, an intermediate wall connected to said backwall and spaced from said bottom wall and including an anti rise distal rail end part engageable with at least one anti rise roller operably connected to said door panel, and an elongated support part engaged with said intermediate wall and said bottom wall to transfer forces acting on said bottom wall and said intermediate wall therebetween, and said support part is releasably secured to said header part by at least one mechanical fastener.

13. In a sliding door system including at least one slidable door panel, a frame including an elongated header part, said header part including a generally vertical backwall, a topwall, a bottom wall including a distal end part thereof forming a rail for supporting door panel support rollers, an intermediate wall connected to said backwall and spaced from said bottom wall and including an anti-rise distal rail end part engageable with at least one anti rise roller operably connected to said door panel, an elongated support part engaged with said intermediate wall and said bottom wall to transfer forces acting on said bottom wall and said intermediate wall therebetween, said header part includes a movable cover for covering a working space in said header part said working space for housing a door operator, said cover includes a hinge part co-operable with a projection supported by said top wall and with a depending leg part connected to said top wall and operable to support said cover on said header part in a closed position and in an open position to provide access to said space, said hinge part of said cover includes a first flange projecting generally parallel to a major part of said cover and a second flange projecting generally normal to said first flange, said first and second flanges of said cover including projections formed thereon co-operable with said projection supported by said top wall and a projection on said depending leg part, respectively, for supporting said cover in said closed position, and a further projection formed on a boss depending from said top wall and co-operable with said projection of said first flange of said cover for supporting said cover in said open position.

* * * * *